United States Patent [19]

Root

[11] Patent Number: 4,913,319

[45] Date of Patent: Apr. 3, 1990

[54] LIQUID DISPENSER AND RETRACTABLE SOAP HOLDER

[76] Inventor: William A. Root, 126 Anita Dr., Pickerington, Ohio 43147

[21] Appl. No.: 278,331

[22] Filed: Nov. 30, 1988

[51] Int. Cl.[4] ..... B67D 5/52

[52] U.S. Cl. ..... 222/135; 222/192; 222/255; 242/107; 248/693; 401/131

[58] Field of Search ..... 222/135, 185, 255, 144.5, 222/192; 242/107, 96; 248/316.5, 359 J; 401/131

[56] References Cited

U.S. PATENT DOCUMENTS

| | | | |
|---|---|---|---|
| 327,022 | 9/1885 | Ross | 242/107 |
| 336,704 | 2/1886 | Delanoy, Jr. | 242/107 |
| 839,337 | 12/1906 | Thomander | 248/359 J X |
| 2,308,771 | 1/1943 | Mooney | 248/359 J X |
| 3,990,611 | 11/1976 | Sojka | 222/135 |
| 4,548,340 | 10/1985 | Messer | 222/135 |

FOREIGN PATENT DOCUMENTS

| | | | |
|---|---|---|---|
| 217729 | 2/1942 | Switzerland | 248/359 J |
| 13757 | of 1910 | United Kingdom . | |

*Primary Examiner*—Joseph J. Rolla
*Assistant Examiner*—Gregory L. Huson
*Attorney, Agent, or Firm*—Francis T. Kremblas, Jr.

[57] ABSTRACT

A bathroom accessory adapted to be mounted on a wall and includes an enclosure having front and rear faces and a pair of separate, inner liquid chamber formed between said faces. Separate pump dispensers are mounted to the enclosure and communicate with outlet openings in each chamber. A spring biased reel, carrying a retractable flexible cable, is mounted within the enclosure with the free end of the cable extending through an opening in the front face. A soap holder comprising an open mesh or liquid permeable flexible material is releasably connected to the free end of the cable. Therefore the soap holder, carrying a bar of solid soap, may be extended away from the enclosure for use and returned automatically to a position closely adjacent the enclosure upon release by the user.

4 Claims, 1 Drawing Sheet

LIQUID DISPENSER AND RETRACTABLE SOAP HOLDER

BACKGROUND OF THE INVENTION

The invention relates generally to bathroom accessories and particularly to a combination liquid dispenser and a holder for a bar of soap.

One of the most common forms of toilet soaps is the solid soap bar widely used in households and motels. However, liquid soaps are preferred by some and liquid shampoos are as common as the solid soap bar.

In spite of its popularity, the solid soap bar retains the disadvantage of being inherently slippery and difficult to hold, particularly when it becomes increasing smaller with use. The bar is often repeatedly dropped by the user.

However, even a relatively new bar of soap tends to become soft or mushy when stored in conventional soap trays and holders. This condition contributes to wastage and further contributes to inadvertent dropping of the bar. Such repeated dropping of the slippery soap bar is particularly annoying when it occurs in a shower. If the person is handicapped or disabled, it becomes a serious problem and can lead to injury during an attempt to retrieve the soap bar.

Another disadvantage associated with conventional solid soap bars is the wastage encountered as the bar becomes smaller with use. Seldom is the bar used completely as it is usually discarded when it becomes so small as to be difficult to handle.

There have been many prior attempts to overcome some of these disadvantages. For example, U.S. Pat. Nos. 4,480,939 and 4,047,259 disclose means to contain a solid bar of soap in a removably mounted holder. U.S. Pat. No. 4,548,340 discloses a liquid dispenser including a combination soap tray which is designed to be permanently mounted within the wall. However, I am not aware of any prior apparatus which conveniently and practically provides a combination liquid dispenser and a soap holder which eliminates the disadvantages set forth above.

SUMMARY OF INVENTION

The present invention relates to the dual function of providing a liquid dispensing means in combination with a soap holder in which a bar of soap is retractably mounted to the enclosure containing a liquid soap or shampoo. A user is provided with the option of using a liquid soap or shampoo and a solid bar of soap in a readily available manner. In the preferred form particularly useful for multiple person households, two separate liquid chambers are provided to increase the options for users for different combinations of liquid soaps or shampoos.

The supporting enclosure is provided with a front and rear face and is adapted to be mounted on the wall of a shower stall in any conventional manner, such as by a suitable adhesive, or it may be hung on a conventional threaded hook type hanger.

A spring-biased reel carrying a retractably mounted flexible cable is mounted within the enclosure with the free end of the cable extending through the front face. Also provided are conventional pump type dispensers for each liquid chamber.

A connecting means, for releasably connecting a mesh type cloth soap holder, is fixed to the free end of the cable to position the holder closely adjacent to the enclosure in a normal position when not in use. The user may use the soap without removing the soap bsar from the holder by merely pulling the holder carrying the soap bar away from the enclosure as far as necessary. The cable automatically returns the soap holder to its original position when released by the user inadvertently or intentionally.

Therefore, the present invention provides a means wherein both a liquid and a solid soap bar are conveniently presented for use with a retractable soap holder which automatically returns the bar to its original position when released. This eliminates any need to retrieve a fallen soap bar from the floor of the shower. The mesh holder also permits a smaller soap bar or a plurality of small pieces of soap to be used more efficiently and tends to make the act of bathing more convenient.

The separate liquid chambers provide a convenient option for a user who may prefer a liquid soap or prefer different types of liquid shampoos. Often members of the same household frequently prefer different brands or types of shampoo.

As a further aspect of the present invention, an elderly or handicapped person is particularly aided by the self-retrieving feature of the holder as its guarantees that the soap bar will always be returned to a convenient position eliminating any difficult or dangerous maneuvering in the shower stall to retrieve a fallen bar of soap.

IN THE DRAWINGS

DETAILED DESCRIPTION OF PREFERRED EMBODIMENT

Figure 1:
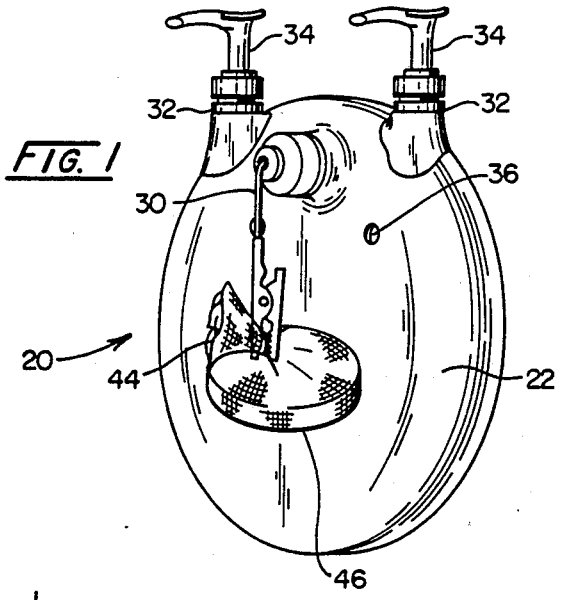
FIG. 1 is a perspective view of a bathroom accessory device constructed in accordance with the present invention.
Figure 2:
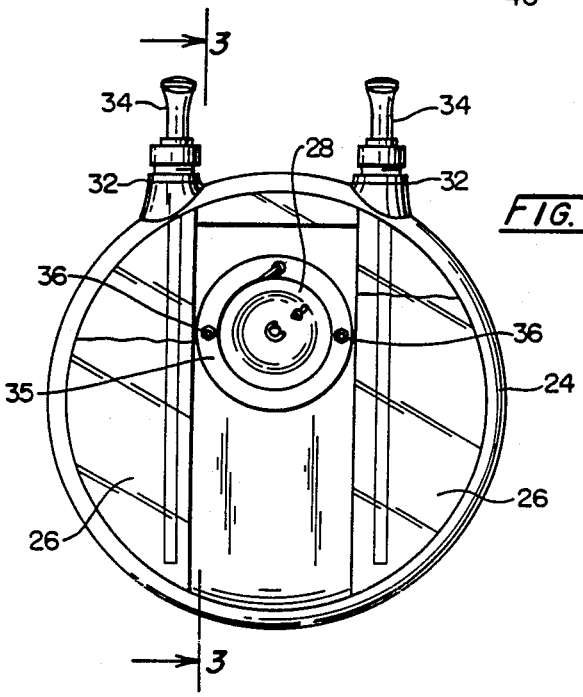
FIG. 2 is a rear elevational view of the device shown in FIG. 1.
Figure 3:
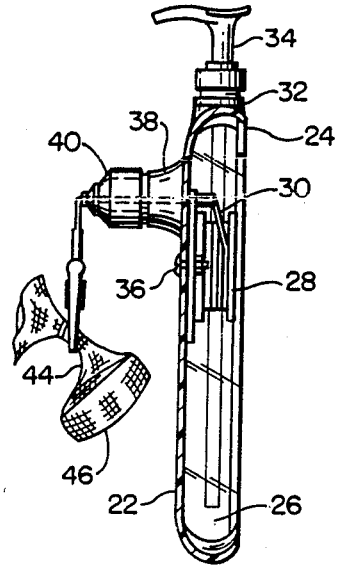
FIG. 3 is a side sectional view of the device shown in the preceding Figures, the section being taken along line 3—3 in FIG. 2.

A bathroom accessory apparatus constructed in accordance with the present invention is shown in FIG. 1–3 and includes a supporting enclosure, indicated generally at 20. Enclosure 20 is shown as generally circular, however it may be formed in other configurations such as square or rectangular if desired. Preferably it is made from a conventional moldable plastic material.

Enclosure 20 is provided with spaced front and rear faces 22 and 24 and possesses a depth sufficient to provide space for a pair of separate liquid chambers 26 and a spring-biased reel 28 which carries a retractable length of cable or cord 30.

The rear face of enclosure 20 may be attached to a bathroom or shower stall wall in any conventional well-known manner, such as by a suitable adhesive or hung upon a hook imbedded in the wall, not shown. The particular form of attachment is optional and alone forms no part of the present invention.

Preferably, each chamber 26 is provided with a necked opening 32 having a threaded portion adapted to receive a conventional female threaded manual pump assembly 34. Liquid soap or shampoo may be poured through each opening 32 upon removal of the respective pump assembly 34.

Reel 28 is a conventional, rotatably mounted, spring-biased reel normally biasing cord 30 in the retracted position shown in FIGS. 1 and 3. Reel 28 includes an assembly plate 35 conventionally fixed by fasteners 36 to front face 22 and supports a shaft, not shown, upon which reel 28 is rotatably mounted.

A front openin, through which the free end of cable or cord 30 extends, is provided in front face 22 and includes a neck portion 38 adapted to receive a threaded cap 40 provided with an exit opening accomodating cord 30.

A releasable clasping or connecting device 42, in the form of a pinch clamp biased in the closed position, is fixed to the free end of cable 30 and is adapted to releasably clasp a soap holder 44.

Soap holder 44 preferably comprises a piece of flexible synthetic material in a mesh or net form, which easily adapts to form a loose fitting bag or closure for a soap bar when the loose ends 46 are gathered together and held closed by clasping device 42. In this form, soap bar 48 may be used without removing it from holder 44 which also serves as a gentle scrubbing aid to the user. In addition, the use of a net holder of this type, permits one to use several smaller fragments of original soap bars which otherwise are usually discarded. The openings in the mesh should be relatively small to retain even very small pieces of soap.

To use the present invention, assuming the chambers 26 are charged with either a liquid soap of a shampoo, as desired, a bar of soap is enclosed within soap holder 44 and the free ends of the holder 44 are closed by clamp 42 to secure the soap bar within the holder. The user merely pulls the holder 44 and cord 30 outwardly to the distance needed to wash a given portion of the user's body. It is recommended that cord 30 be at least five or six feet long to assure adequate length for the user to manipulate easily to reach all portions of his body without difficulty.

When the soap holder 44 is inadvertently or intentionally released, reel 28 automatically retracts cord 30 and holder 44 to its original position. Therefore the user never has to retrieve the soap bar from the floor of the shower stall.

While the mesh type holder 44 tends to make holding onto a wet soap bar much easier to reduce the tendency for it to slip from one's grasp, there are times during a shower when the user wishes to use both hands free of the soap bar. Prior to the present invention, this required the user to bend over or otherwise maneuver to replace the soap bar in a conventional soap tray or the like. Using the present invention, this additional maneuver is not required as mere release of holder 44 causes holder 44 to be automatically retracted to its original, easily reached starting position.

If the user prefers a liquid soap, such as in multiple person households, one of the chambers 26 may be charged with the desired brand and used by merely pumping the appropriate pump assembly 34.

In many situations, multiple person households use different brands of shampoo and the multiple chambers 26 conveniently offer such an option.

Further, as often occurs, other members of a household prefer different types or brands of solid soap bars. A different bar may be replaced in holder 44 very quickly by merely releasing pinch clamp 42 to release the ends of the mesh material of holder 44. A new soap bar is easily substituted and the mesh holder 44 is closed around the soap bar as previously described.

In view of the foregoing description, it should be readily appreciated that the present invention provides a much improved bathroom or shower accessory apparatus which eliminates the major disadvantages of using solid soap bars and provides added convenience for all users. It is particularly beneficial to injured or handicapped persons who otherwise are exposed to greater inconvenience and injury when attempting to retrieve a dropped soap bar during a shower. Additionally, the present invention provides a combination of a liquid dispenser and a solid soap bar holder which is relatively easy to manufacture at practical costs.

What is claimed is:

1. A soap holder and liquid dispensing apparatus comprising, in combination, means forming an enclosure having a front and rear face, said front face including an outwardly protruding neck portion communicating with an interior portion of said enclosure and provided with a tapered horizontally facing opening, said rear face configured to be attached to a planar outer wall surface, said enclosure including at least one inner chamber formed between said front and rear faces for storing a liquid; a pump dispensing means mounted in communication with said chamber for selectively dispensing liquid from said chamber; means for retractably storing a predetermined length of flexible cable mounted within said enclosure and separated from said chamber, said flexible cable having a free end extendible through the horizontally facing opening in the front face of said enclosure and normally biased to return to a predetermined position closely adjacent to an outer side of said front face; connecting means fixed to said free end of said cable; a soap holder mounted to said connecting means, said holder formed of a flexible liquid permeable material and conformed to releasably surround a solid soap bar; whereby said soap holder may be extended away from said enclosure a distance determined by the length of said cable and automatically retracted when released to a position closely adjacent to said front face of said enclosure.

2. The apparatus defined in claim 1 including at least a second separate chamber between said front and rear faces for storing a liquid and a second pump dispensing means mounted to said enclosure in communicating relationship to said second chamber.

3. The apparatus defined in claim 2 wherein said means for retractably storing a length of cable comprises a rotatably mounted reel biased to wind said cable upon said reel and permitting unwinding said cable from said reel against a predetermined spring force.

4. The apparatus defined in claim 3 wherein said soap holder comprises a flat sheet of flexible liquid permeable material and said connecting means includes a releasable clamp releasably fixing opposing sides of said sheet in surrounding relationship to a solid soap bar.

* * * * *